United States Patent [19]

Krakauer

[11] 4,114,212

[45] Sep. 19, 1978

[54] BED SPRING UNIT AND METHOD

[75] Inventor: Edwin G. Krakauer, Roslyn Heights, N.Y.

[73] Assignee: Kay Manufacturing Corp., Syosset, N.Y.

[21] Appl. No.: 771,038

[22] Filed: Feb. 22, 1977

[51] Int. Cl.[2] ..... E04C 02/42; A47C 23/04

[52] U.S. Cl. ..... 5/267; 5/259 B; 52/665

[58] Field of Search ..... 5/259 R, 259 B, 267, 5/351; 403/397; 140/3; 267/101, 102; 256/54, 57; 52/665, 685, 686

[56] References Cited

U.S. PATENT DOCUMENTS

| | | | |
|---|---|---|---|
| 1,742,917 | 1/1930 | Landell | 5/259 B |
| 3,672,738 | 6/1972 | Buttriss | 312/71 |
| 3,748,808 | 7/1973 | Sheppard et al. | 52/665 |
| 3,777,322 | 12/1973 | Lavkin | 5/267 |

*Primary Examiner*—Casmir A. Nunberg

[57] ABSTRACT

A preformed grid of perpendicularly intersecting wires equally or unequally spaced apart and welded together or part of such grid such as a pair of parallel wires and a binding cross wire, are tightly joined together as well as to the top turn or ring of a coil spring by an inverted U-shaped wire clip detached and fed preferably automatically from a cemented group of such clips much like conventional staples. An upper grid wire is arranged to span the ring diametrically while a pair of lower wires parallel to each other are arranged as respective opposed chords of the ring each spaced inwardly at its weld from the adjacent perimeter of the ring just enough to permit the insertion of a clip leg or legs at an inward and downward slant into the space between the perimeter of the ring and the chord portion of the other wire while straddling the spanning wire. The legs are then bent outwardly and bent tightly around the ring so far as is necessary to press one or both into a wrapped position around the ring and to carry the wires down into pressed contact with the top of the ring thus making an indent in the chord. A second similar clip similarly connects the other chord and the spanning chord with the ring turn at the opposite point of the ring.

16 Claims, 6 Drawing Figures

BED SPRING UNIT AND METHOD

This invention relates to assemblies of wires, rings and connectors and to making such assemblies.

The invention is particularly applicable to bed spring units such as box springs while also usable in other environments such as those where wires or wire grids are connected to one or more ring-like elements ("rings" hereinafter). In what follows the wires will be treated as though they are parts of a complete preassembled grid of intersecting generally straight wires welded together where they intersect. Each of the rings will be described as though it were the top turn of a wire spring coil and the connector joining the ring to a wire will be treated as a wire "clip" and so termed. The clip is initially in the general shape of an inverted U and will be more fully described hereinafter. Each grid wire extending in one direction and arranged above the other will be termed a "first" wire and each of the lower wires will be termed a "second" wire.

Heretofore, in assemblies of grids and coil springs as used for example, in bed springs, it has been customary to employ links or secondary operations such as welding or crimping the wires or rings or connecting the parts by means of additional locking wires or the like. The present invention is directed to the provision of a ring and wire combination or assembly which eliminates such secondary operations as well as the addition of relatively expensive wires or links to the grid so that the invention produces economically a tight dependable durable and stable connection solely by means of an inexpensive wire clip quickly and easily installed.

The invention is further directed to the employment of a short wire clip of inverted U-shaped form as the fastener or connector of the assembled wires and ring, which clip is cemented to a row or group of such clips in the conventional manner in which staples are made and sold which is adapted to be quickly and easily separated from its group and quickly installed by a suitable portable machine designed to wrap the clip around the ring.

The invention is further directed to the method of making the assembly including the required indent in one of the second wires as the clip is wrapped around the ring.

The above and other objects are best attained by using the upper wires of a grid as the first wires and arranging said wires diametrically across the ring or rows of rings in a bed spring with each of the second wires as a chord of the ring and just close enought to the perimeter of the ring to permit at least one leg of the clip to be easily inserted within the ring and adjacent the chord as the clip straddles the first wire. By means of a suitable portable machine holding a row of clips, a clip is removed from the row or group of clips, at least one of its legs inserted into place, the legs wrapped into a holding position to the required extent and at least part way around the ring, to hold the ring from escaping out of the clip, and a tensioned indent formed in the chord of the second wire by the downward clip-wrapping force exerted by the machine on the first wire.

The detailed structure of the invention will become clear as the description progresses and from the drawings, in which FIG. 1 is a top plan view of a typical ring, wire and clip assembly.

Figure 5:
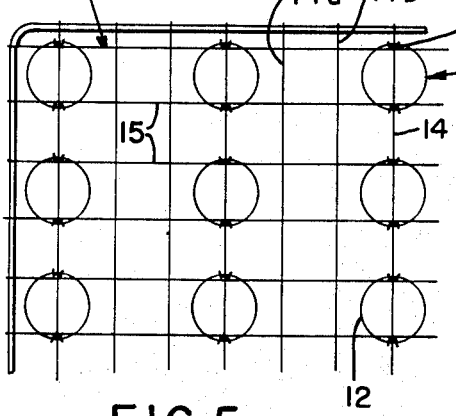
FIG. 5 is a fragmentary diagrammatic top plane view of a spring unit showing one arrangement of the grid wires and coil springs.

In the practical embodiment of the invention as it appears applied to a bed spring, the grid 10, FIG. 5 and the top turns or rings 11 of the spring coils 12 are connected by the inverted U-shaped clips 13. The grid is of more or less conventional construction but spacing apart of the various parallel wires thereof may vary considerably depending on the density of the spring coil arrangement in a given area. The grid 10 of FIG. 5 comprises a set of upper first wires 14 and a set of lower second wires 15 welded to the under side of the wires 14 where they cross the latter perpendicularly.

The spacing between operative first wires 14 depends on the spacing between and the arrangement of the spring coils in a given row. In FIG. 5 all the parallel wires are shown spaced equally apart for convenience, the distance of the spacing being somewhat less than the inner diameter of the rings. However, additional parallel wires may be interposed in the grid between and parallel to the operative wires 14 as required or desirable to support padding or perform any other function for which the assembly or part thereof is designed. Two extra wires **14*a* and 14*b* not connected to rings are shown in FIG. 5** and support padding in a bed spring thereby aiding to transfer the load to the coils.

Figure 6:
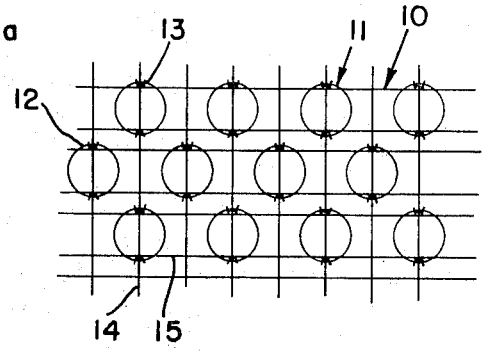
FIG. 6 is a similar view of another arrangement of the wires and springs.

In FIG. 6 every first wire is connected to a ring to obtain a high density of coil arrangement. Alternate rows of coils are staggered whereby the coils become aligned in inclined rows angularly related to the perpendicular rows.

Figure 4:
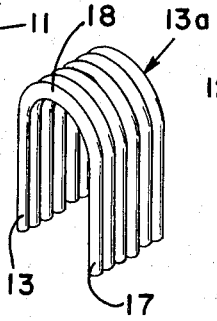
FIG. 4 is a perspective view of part of a group of clips.

The second wires 15 intended to be connected to coils are spaced apart enough to constitute in part chords of the rings. Each wire 15 is close enough to the adjacent perimeter of the ring just to permit at least one of the legs 17 while it is still straight (FIG. 4) of the clip 13 to be inserted easily and at a downward and inward slant between the ring and the second wire 15 adjacent thereto as the clip straddles the first wire.

Figure 3:
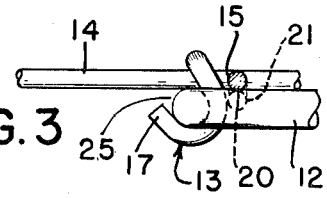
FIG. 3 is a fragmentary side elevational view of FIG. 2.
Figure 2:
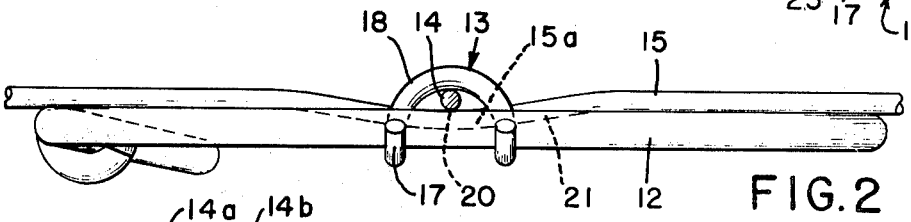
FIG. 2 is a front elevational view of the front portion of FIG. 1.

It has been found that the described inclination or angular relation other than perpendicular of the clip legs to the ring avoids possible rotation of the clip in a direction and to a position which might permit the ring to loosen and finally to escape from the clip. As has been indicated the clip is initially part of a row or group of such clips cemented together in a manner much the same as conventional staples are commonly made and sold. An end clip is removed from the group **13*a* by a suitable portable clipping machine which holds the group. The clip is rapidly fed into place and installed by the machine being pressed down firmly and completely on to the wire 14 and wrapped around the ring to embrace the ring to the required extent (FIG. 3). The initially straight legs 17 of the clip are integrally joined at their top ends by a bend or arcuate portion 18 preferably of semi-circular form. As the clip is pushed down by the machine an indent is automatically formed in the wire 15 and the legs are bent outwardly to the desired extent around the ring. The clip wrapping operation forces the inner surface of the bend 18 to engage the top of the wire 14 and to press said wire firmly down on to the ring top. Such movement carries the weld 20 at the intersection of the wires 14 and 15 downwardly as the wire 15 is pressed down at the middle of the chord portion 15***a* by the upper wire 14 thereon. Said chord is thereby indented automatically by an amount equal to the thickness of said wire as best seen in FIGS. 2 and 3 to form the indent 21.

The weld 20 is not directly subjected to any damaging pressure during the clipping or wrapping operations. The weld is actually reinforced by the connection of the wires and ring. It is out of direct contact with the padding intended to cover the coils and is protected by that part of the wire above the weld. The force exerted by any load on the grid or assembly is resisted and counteracted by the tension inherent in the indent and the tendency thereof to straighten out whereby the indent actually aids in reducing the load on the weld.

Figure 1:
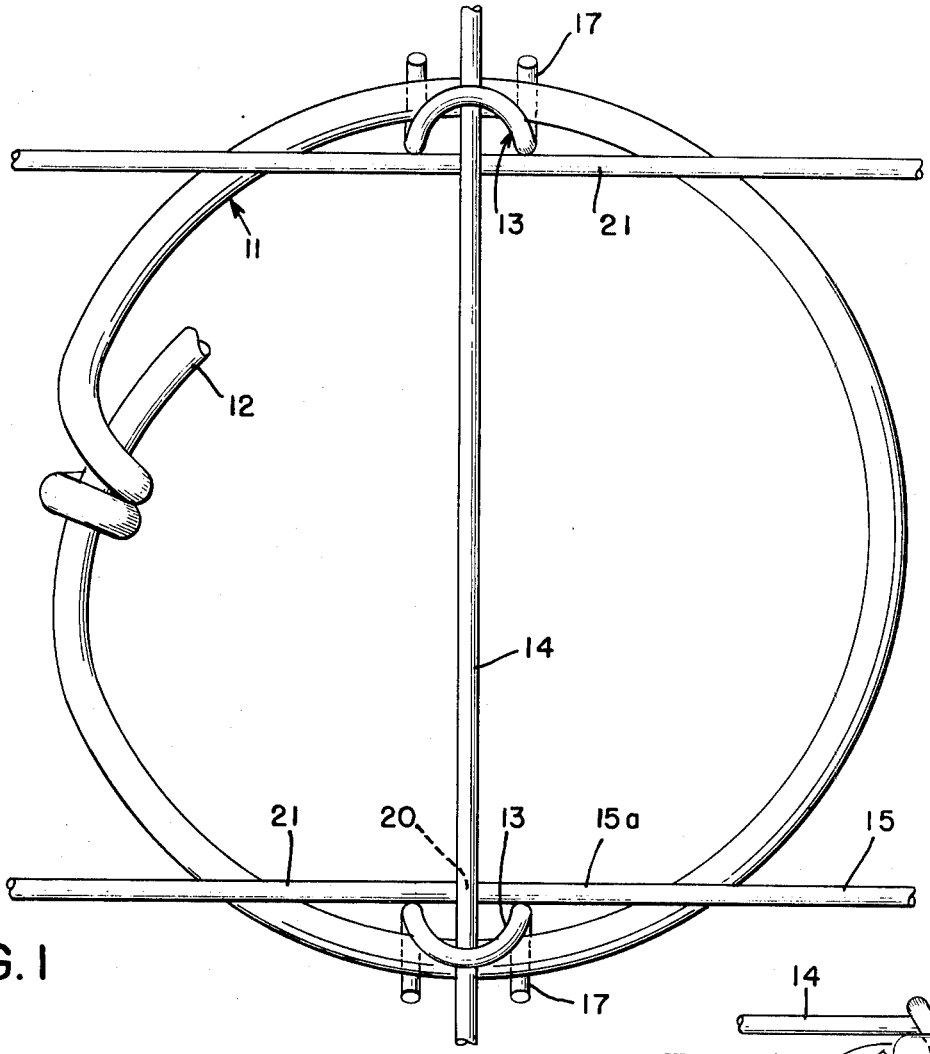

To complete the assembly as best seen in FIG. 1 a duplicate of the connection adjacent the weld 20 is made at a diametrically opposite point of the ring. The duplicated connection is best seen in FIG. 1 and merely involves another wire 15 and another clip 13.

Obviously, the clip is closed as far as is practical and economical with the use of a portable or fixed machine which also feeds a clip. When duplicate opposed connections to the ring are used damaging movement of the ring relativeiy to the wires is effectively resisted by wrapping the clip to a quite limited extent around the ring. The clip closure is enough to prevent escape of the ring from the clip even if only one connection is made regardless of the stresses to which the connection may be subjected in anticipated use; that is, if the legs of the clip are wrapped around the ring so that the least width of the escape opening 25 (FIG. 3) is less than the diameter of the ring wire.

Said opening is the space in the assembly between the upper part of the ring and the under part of the adjacent wire 14. Consequently while the clip closure may be complete if desired it is more practical in mass production to close or wrap the clip incompletely around the ring.

It will now be seen that a simple and inexpensive connection and connector have been provided for assembling a grid or part thereof to a ring as well as a method of making the assembly to form a tight and dependable joint and that the objects of the invention have been adequately attained.

While one form of the invention has been shown and described involving the insertion of both legs of the clip between the wires 15 and the ring and the wrapping of both legs around the ring, other insertion and wrapping steps are within the scope of the invention and other obvious changes may be made without departing from the spirit of the invention defined in the appended claims.

I claim:

1. In a bed spring unit, the assembly of a wire grid, a multiplicity of spring coils each terminating in a top ring having a circumferential perimeter and wire means connecting the grid to two opposite points of each ring, said grid comprising two sets of substantially straight wires, one set of said substantially straight wires consisting of a plurality of spaced substantially parallel upper first wires, the other set of said substantially straight wires being second wires substantially parallel to each other and substantially perpendicular to the said first wires and welded to the under sides of the said first wires at the intersections of the said respective first and second wires, said wire means having a first wire and two second wires connected together within the circumferential perimeter of each top ring and resisting movement of the said top ring relatively to the said wire grid, said wire means having a wire clip arranged at each of two diametrically opposite points of said top ring, each said wire clip having two spaced apart legs joined integrally at the respective upper ends thereof by an arcuate portion, each of said first wires of the assembly crossing a top ring at two diametrically opposite points thereon and being in pressed contact with the top of the ring, two of said second wires also crossing and being in pressed contact with the top of the ring and each said second wire in part forming a chord portion of said ring top, at least one of said clip legs passing through the space between the said chord portion and the adjacent circumferential perimeter of the ring top and at least one of the legs being wrapped to a selected extend around the ring top.

2. The spring unit of claim 1, the extent of thw wrapping of a clip leg around the ring top being sufficient to compress said ring top adjacent to the said arcuate end portion of the clip and a clip leg.

3. The spring unit of claim 1, the maximum space between the middle of the said chord portion of each of the said second wires and the adjacent circumferential perimeter of the ring top being not substantially more than the thickness of the legs of the said wire clip.

4. The spring unit of claim 1, each said chord portion of the said second wires having a depressed indent therein of maximum depth where the said straight first wire crosses the top of said chord portion, said depth being substantially equal to the thickness of said second wire.

5. The spring unit of claim 1, the arcuate end portion of the said wire clip straddling and pressing said first wire against the top of the ring, those portions of the said second wire over the circumferential perimeter of the ring being pressed against the top of the ring and thereby indenting the said second wire where said second wores cross said first wires and are welded together, by an amount equal to the diameter of said second wire.

6. The spring unit of claim 1, the clip legs being inclined downwardly and inwardly in the space between the ring and the adjacent second wire.

7. The spring unit of claim 2, both legs of the clip being wrapped outwardly to the outside of the ring.

8. The spring unit of claim 2, at least one leg of the clip being wrapped outwardly to the outside of the ring, the legs terminating a distance substantially less than the diameter of the ring wire from the under side of the first wire, thereby obstructing escape of the ring from the clip.

9. The spring unit of claim 1, both legs of each clip being wrapped outwardly to the outside of the ring, the arcuate end portion of the clip straddling and pressing the first wire against the top of the ring, the ends of the chord portion of the second wire also pressing against the top of the ring, said chord portion having an indent therein of maximum depth equal to the thickness of said second wire at the intersection of said first and second wires, each ring being the top turn of a spring coil, a multiplicity of spring coils arranged in two mutually perpendicular rows, selected rows being spaced apart a distance greater than the diameter of the rings in said rows.

10. The spring unit of claim 9, selected rows being free of the rings.

11. The spring unit of claim 9, the rings is selected rows being spaced away from adjacent rings a distance less than the diameter of the rings and being also arranged so that selected rows are angularly related to the perpendicular rows.

12. The spring unit of claim 9, the distance varying between selected wires of groups of parallel wires thereby to space the rows apart different distances.

13. The spring unit of claim 9, the distance between a second wire in one selected row and the adjacent second wire in the adjacent row being less than that between the second wires of the same row.

14. The spring unit of claim 1, the clip being initially in the shape of an inverted U and initially cemented to a group of identical clips and being adapted for separation individually from the group and installed to join the ring and first wire.

15. In a bed spring unit construction, the assembly of a grid surface having a first plurality and a second plurality of linear elements secured together at selectively spaced positions to form a supporting planar surface, a plurality of spaced spring coils aligned in columns and rows with each of said coils terminating in a top ring for connection to said grid planar surface, each column of aligned spring top rings having a first linear element extending diametrically across said column of said linear top rings and contacting said rings at diametrically opposite positions, a pair of said spaced second set of linear elements extending transversely below said first linear element in engagement therewith and with said top rings forming oppositely positioned chordal sections in said diametrically opposite positions, and individual means extending into each of said chordal sections between said ring and a second linear transverse element locking said first linear element to said top ring.

16. In a bed spring unit construction as claimed in claim 15, said individual means including a continuous U-shaped member having depending legs connected by an arcuate intermediate first linear element engaging portion, each of said legs straddling said first linear element and being up turned arcuately to at least partially enwrap said ring adjacent to said first linear element.

* * * * *